United States Patent [19]

Pahl et al.

[11] 4,194,361

[45] Mar. 25, 1980

[54] ELECTRO-MECHANICAL CONTROL SYSTEM FOR HYDRAULIC DISPLACEMENT PUMPS, SUCH AS SWASH PLATE OR ECCENTER PUMPS

[75] Inventors: Arnold Pahl, Gerlingen; Hans-Jürgen van der Kolk, Sersheim; Manfred Lixenfeld, Mettmann, all of Fed. Rep. of Germany

[73] Assignee: Robert Bosch GmbH, Stuttgart, Fed. Rep. of Germany

[21] Appl. No.: 907,598

[22] Filed: May 19, 1978

[30] Foreign Application Priority Data

Jun. 18, 1977 [DE] Fed. Rep. of Germany ..... 2727555

[51] Int. Cl.[2] ..... F15B 9/00

[52] U.S. Cl. ..... 60/388; 60/390; 60/391; 60/392; 60/403

[58] Field of Search ..... 60/388, 390, 391, 392, 60/403, DIG. 2

[56] References Cited

U.S. PATENT DOCUMENTS 3,212,263 10/1963 Hann ..... 60/403 X 3,667,225 6/1972 Karman ..... 60/390

4,055,047 10/1977 Kawasaki ..... 60/DIG. 2 X

*Primary Examiner*—Edgar W. Geoghegan

*Attorney, Agent, or Firm*—Frishauf, Holtz, Goodman and Woodward

[57] ABSTRACT

To permit mechanical override of an electrical command system to control deflection of the swash plate or eccentricity of an axial or radial piston pump, for example upon failure of the electrical control system, a group of valves 5–8 are connected to an electrical control unit 23 and an additional control valve 4, 4' with a manual control lever 18', 30' is provided, the deflection of the swash plate 1 or eccenter ring 28 of the pump being sensed by a position transducer 22 moved by a linkage which includes the manual control lever. In normal operation, the manual control lever is maintained by spring pressure to deactivate the control valve but, under emergency conditions, the manual control lever will operate the first control valve 4, 4' to admit hydraulic control fluid to position the swash plate, or eccenter ring, respectively, the consequent movement of which is fed back through the linkage to the manual control lever.

13 Claims, 3 Drawing Figures

ELECTRO-MECHANICAL CONTROL SYSTEM FOR HYDRAULIC DISPLACEMENT PUMPS, SUCH AS SWASH PLATE OR ECCENTER PUMPS

The present invention relates to displacement pumps, and more particularly to axial or radial piston displacement pumps in which the piston displacement is controlled by a swash plate or wobble plate for an axial displacement pump, or by an eccentric ring for a radial displacement pump; and especially to composite manual and electrical control of such pumps.

BACKGROUND AND PRIOR ART

Displacement pumps may require substantial force for control of a movable mechanical element which determines the displacement of the displacement pump—typically a swash plate or an eccentric ring. To permit remote control of the displacement of such pumps, it has previously been proposed to provide electrical control units which, selectively and through valves, admit pressure fluid to pistons acting on the movable mechanical element. It has been proposed to mechanically connect a manual lever with the movable mechanical element which, additionally, controls the slider of a control valve, for example of a spool valve. The manual lever is positioned in accordance with a desired deflection of the mechanical movable element and, in accordance therewith, a pressurized hydraulic fluid is controlled by the control valve to move the moving piston connected to the mechanical element to deflect the element in the desired direction. The mechanical connection of the element with the manual lever on the one hand, and with the slider of the control valve on the other hand forms a closed loop so that the slider of the control valve will interrupt admission of additional pressurized hydraulic fluid to the positioning piston after the mechanical element, typically the swash plate or the eccentric ring, has reached the desired position. It is thus possible to change the position of the mechanical element by a predetermined adjustment of the manual lever based on a mechanical follower system by any desired amount.

It is frequently desired to provide for remote control of such displacement pumps. It has thus been proposed to control the admission of pressurized fluid to the adjustment pistons of the pumps by means of an electronic control unit. The inclination or eccentricity of the respective mechanical element is sensed by a position transducer and the actual position is then applied to a control unit, together with a commanded position. An error signal is developed which then is applied as a control signal to hydraulic valves to admit pressurized hydraulic fluid to the adjustment pistons or, respectively, drain pressurized fluid therefrom.

The electrical control is particularly applicable for remote control installations. It was not possible heretofore, however, to combine the reliability of the hydromechanical adjustment and the flexibility of electronic control, which additionally permits remote control and, therefore, if design requirements made remote control necessary, it was not possible to provide a system which could continue to operate even if defects in the electronic control system would arise.

THE INVENTION

It is an object to combine the advantages of the reliability of mechanical control of a piston displacement pump with the flexibility afforded by electrical control systems with a minimum of elements and additional apparatus.

Briefly, in addition to the selectively energized valves, controlled by an electrical control unit, a further valve is provided which is manually controllable but, under normal conditions and when the electrical system is functioning properly, is maintained hydraulically disconnected from the system. A mechanical hand lever is connected to the main control valve to selectively admit pressurized fluid to positioning pistons of the respective mechanical elements of the pumps controlling the displacement—that is, a swash plate, eccentric ring, or the like—which mechanical lever is likewise linked to the mechanical element and further to a position transducer, the position transducer feeding back deflection of both the hand lever as well as of the mechanical element controlling displacement of the respective pump.

The system, therefore, permits remote control of the displacement pump by electrical control of valve units but still, for example under emergency conditions, permits manual override, by combining the advantages of the manual system and the remote control electrical system. The hydro-mechanical servo control is so arranged that, in normal operation, the electro-hydraulic commands are directly transmitted in the form of hydraulic pressure fluid flow to positioning pistons of the displacement pump. Upon failure of the electro-hydraulic system, however, the position of the mechanical deflection element controlling the displacement of the displacement pump will be maintained and, if desired, can be changed by operator control of the manual lever, the entire system functioning as one integral unit in which the feedback link associated with the mechanical deflection element is common to both the electrical as well as the emergency manual control system.

Drawings, illustrating preferred examples, wherein.

Figure 1:
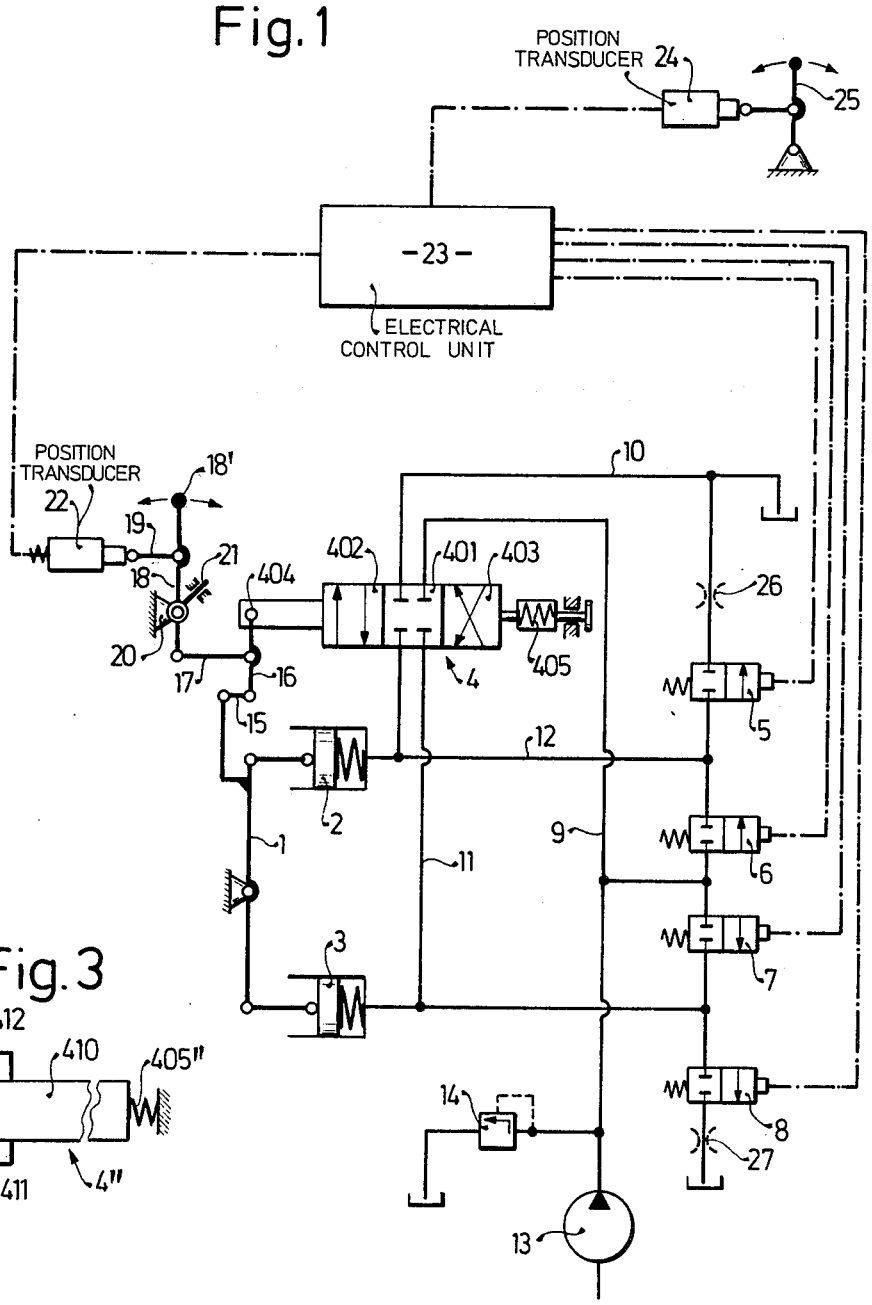
FIG. 1 is a general hydraulic electrical and mechanical diagram of the control system applied to a swash plate or wobble plate displacement pump, with hydraulic displacement positioning control.

A swash plate 1 of a swash plate pump is positioned by two pistons of hydraulic piston-cylinder arrangements 2, 3. The invention is applicable to various types of swash plate pumps, which are well known, and therefore the structure of the pump itself has been omitted. The swash plate pump, upon being deflected from a neutral position (shown in FIG. 1) bears against axial pistons; deflection of the swash plate 1 from the position shown will control the stroke of pistons bearing against swash plate 1. The deflection of the swash plate 1 is determined by the piston-cylinder arrangements 2, 3 which receive hydraulic control fluid over a first control valve 4 or, respectively, over a group of control valves 5, 6, 7, 8, forming second through fifth control valves. The first control valve 4 is formed as a 4/3-way valve with a reset spring 405, and is connected to two lines 9, 10 forming supply and two lines 11, 12 forming the outflow connections. In the normal or rest position, the valve interrupts communication between lines 9, 11 and 10, 12. The rest or normal position is shown as block 401 in FIG. 1. In one operating condition, shown as block 402, communication is established between the pressure line 9 and outflow line 11; and a drain line 10 and outflow line 12. In the second working position, shown as block 403, the communication between drain and pressure lines and the respective outflow lines 11, 12 is reversed, as schematically indicated by the crossed arrows in block 403, that is, pressure line 9 is connected to outflow line 12 and drain line 10 to outflow line 11.

The group of control valves 5–8, which are electrically controlled, are 2/2-way valves with a reset spring; in other words, they are ON/OFF valves. For convenience, the valves 5–8 are shown as separate units although they can be combined, of course, for example in form of differential valves. The operation of the system will not change thereby. The valves 5–8 are, selectively, connectable to drain line 10 which leads to a drain sump and to pressure line 9 which is connected to a pressure pump 13. Pump 13 is further connected to a pressure control valve 14 which, in order to maintain pressure at a given level, also is connected to the drain sump. Accordingly, valve 5 is connected to line 10 and to the outflow line 12 from the main valve 4. The outflow line 12 is, additionally, connected to valve 6. Valve 6 is further connected to the pressure line 9 which, likewise, is connected to valve 7. The other side of valve 7 is connected to the outflow line 11 and to one side of valve 8, the other side of which is again connected to a drain sump, that is, to a low or no-pressure line similar to line 10. Hydraulic chokes 26, 27 are preferably interposed between the connections from valves 5 and 8 to the respective drain or sump; these hydraulic chokes or throttles are not strictly necessary and, therefore, have been shown in broken lines; their function will be explained below.

The outflow line 12, connected also to the valves 5, 6, is connected to the positioning piston 2; the outflow line 11, also connected to the valves 7 and 8, is further connected to the positioning piston 3.

Figure 3:
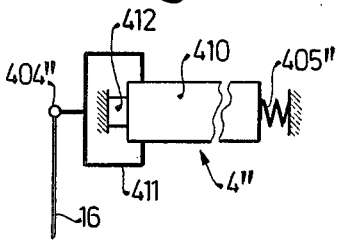
FIG. 3 is a fragmentary diagram illustrating a modification of the system of FIG. 1, but equally applicable to FIG. 2.

The movable mechanical displacement element which controls the displacement of the displacement pump, in FIG. 1 the swash plate 1, is connected to a linkage having first, second, third, fourth and fifth link elements 15, 16, 17, 18, 19. The deflection element 1 is connected through link elements 15, 16 with a link point 404 which controls the position of the slider of the valve 4. In a modification, shown in FIG. 3, a valve 4'' is provided in which the slider 412 is fixed, but the outer housing 410 is maintained by a spring 405'' in the normal or rest position. The internal connection of the valve 4'' is identical to that of FIG. 1, the only difference between the embodiment of FIG. 3 and FIG. 1 being the reversal of the relative movement of the slider and the housing with respect to a fixed point. Thus, the housing 410 is formed with a bracket 411 to which a linkage point 404'' is connected which, in turn, has link 16 connected thereto similar to point 404 in FIG. 1. The second link 16 is connected to a third link element 17 which, in turn, is connected to a fourth link element 18 which is pivoted about a fixed bearing 20. To permit free operation of the linkages without play, the various link points are spring-loaded, as schematically shown only with respect to the pivot on link 18, where a spring 21 schematically indicates that the pivot bearing is maintained in contact by means of a loading spring 21, in accordance with known engineering practice. The lever 18 terminates in a manual control extension 18' and, additionally, is connected to a link 19 which is connected to an electrical position transducer 22, providing an electrical output signal representative of deflection of the link element 18, and hence of element 19, as the swash plate 1 changes position from the neutral position shown in FIG. 1.

An electrical control unit 23 has command inputs provided by a manual command lever 25 which is connected to a position transducer 24. The control unit 23 provides output signals to the respective valves 5, 6, 7, 8 in accordance with commands transmitted by the lever 25. Control units to provide, selectively, commands to hydraulic valves for selective connection to a pressure line or to a drain line are known.

Operation (1) Electrical (if desired, remote) control under command of command lever 25: In normal, electrical command operation of the displacement unit, the main valve 4 is maintained in the rest position shown in FIG. 1 by the spring 405. The linkage point 404 (or 404''—FIG. 3) is thus fixed in space. Any movement of the deflection element or swash plate 1 will be transmitted by the linkage system 15, 16, 17, 18, 19 to the first position transducer 22. The position transducer 22 therefore provides an output signal representative of the actual position of the swash plate 1. This output signal is supplied to the control unit 23 as an actual position signal. The command lever 25—or any equivalent input unit which, for example, may be pushbutton or program controlled—provides a command position through the position transducer 24 to the control unit 23 which develops an error signal if the command signal and the actual position signal are different. If an error signal is developed, then the valves 5, 6, 7, 8 are selectively energized by the control unit 23 in such a manner that the swash plate 1 is changed in position by means of the pistons 2, 3, as desired. For example, if the command input as transduced by transducer 24 requires rotation of the swash plate in clockwise direction, the second control valve 5 and the fourth control valve 7 will be energized, while the third and fifth control valves 6, 8 will remain deenergized. Energization of valves 5, 7 permits flow of pressurized fluid from pump 13 through pressure line 9, open valve 7 to outflow line 11 and hence to piston 3; previously supplied pressure fluid can drain from the piston 2 through outflow line 12, valve 5, and to the drain line 10, and hence to the sump. Movement of the swash plate 1, under control of the pistons 2, 3 will continue until the position transducer 22 provides an output signal which corresponds to the command signals supplied from position transducer 24, that is, until the error signal is null. The actual position of the swash plate 1 will then correspond to commanded position. At that time, the two valves 5 and 7 are again closed, hydraulic fluid will be locked in the cylinders of respective pistons 2, 3 and the connection lines from the valves, and the swash plate 1 will maintain its commanded position.

The reset spring 405 of the first valve 4 (and, also, spring 405'', FIG. 3) has a higher spring force or strength than the sum of the friction forces occurring in the linkage 15–19 and of the spring forces of the anti-backlash springs, as shown, spring 21. Thus, the first valve 4 will remain in the neutral or hydraulic disconnect position upon normal electrical command of the system. Command signals which are electrically applied to the control unit 23, and commanding operation of the respective valves 5–8, thus are not affected by the presence of the valve 4. Adjustment arrangements, as well known, can be provided in the control system, for example by suitably adjusting the position transducers 22, 24 and the link connection 404 so that the servo loop will function properly and position the swash plate as desired.

(2) Manual operation, direct manual command: Upon failure of the electical control unit, or for other reasons when it is desired not to use electrical commands derived from the electrical control unit, it is possible to control swash plate 1 manually, by moving the manual lever 18'.

Let it first be assumed that all the valves 5–8 are closed, and no further command signals are supplied by the electrical control unit 23. The swash plate 1 will remain in the position that it had when further signals from control unit 23 fail. Manual operation of the fourth link element 18 by moving the manual extension 18' can then be used to operate the first valve 4 and connect the pressure line 9 and the drain line 10, respectively, to outflow lines 11, 12 to change the position of the swash plate 1 to that which it had at the time of failure of signals from the control unit 23. This change of position is obtained in the well-known hydro-mechanical servo control, as described above. Let it be assumed, again, that it is desired to change the position of the swash plate 1 in clockwise direction. The manual lever extension 18' is then moved towards the left so that the first control valve 4 will be moved into the position shown by block 402. Pressurized fluid will flow from supply line 9 to the outflow line 11 and into the cylinder of piston 3; fluid can drain from the cylinder of piston 2 through the outflow line 12 and drain line 10 to the sump.

As described above, the swash plate 1 will maintain its position if the valves 5–8 are closed when the control unit 23 fails. Situations can arise, however, in which it is desired to permit resetting of the swash plate 1 to neutral position, shown in FIG. 1, upon failure of the control unit 23. In such an arrangement, the control valves 5–8 are so arranged that they will open, when deenergized, rather than holding their previous position. Hydraulic chokes or throttles 26, 27 are then used in order to permit manual shift of the swash plate 1 by the fourth link element 18 in order to prevent uncontrolled drainage or short-circuiting of pressurized supply from pump 13 through line 9 and the open valves 5–8. For example, throttle 27 is needed in order to prevent backflow of pressurized fluid from the pressure line 9 and outflow line 11 when the main valve 4 is in the position shown by block 402 through the fifth valve 8 into the sump.

Figure 2:
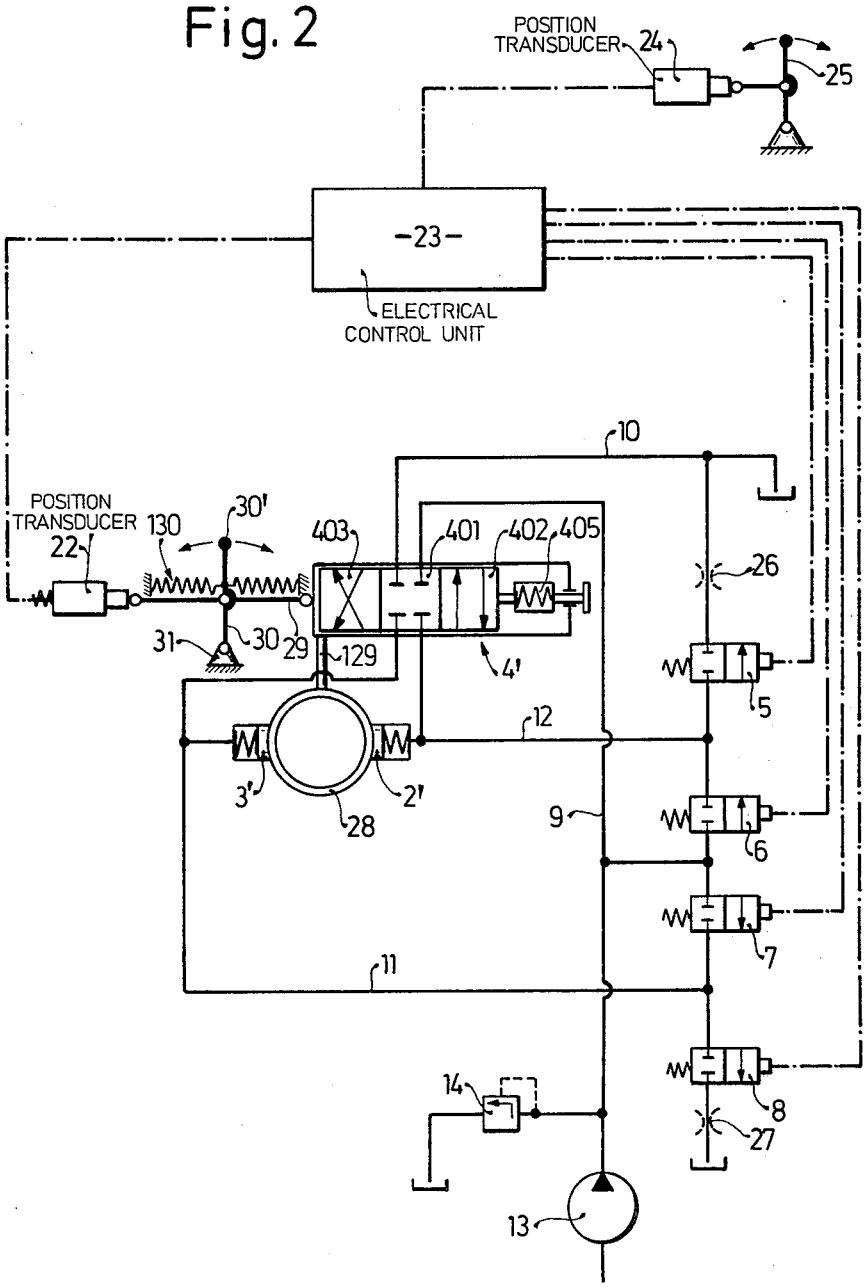
FIG. 2 is a diagram similar to FIG. 1 in which the system is applied to a radial piston, eccentric-type pump.

FIG. 2 illustrates a system in accordance with the invention applied to a radial piston pump, for example of the eccentric type. Similarly constructed and operating components have been given the same reference numerals and will not be described again. The essential construction of the system is similar to that of FIG. 1. The adjustment pistons 2', 3' are connected to a race 28 to shift the race 28 with respect to a circle which is concentric with the race 28 when the race 28 is in neutral or central position, that is, when the pistons 2', 3' are in symmetrical balance. The race 28 is mechanically connected to the outer sleeve of the valve 4', as schematically shown by the link 129. A suitable linkage arrangement or link train may be used. A link element 29 is connected to the control slider or spool of the valve 4'. The link 29 is also connected to a manual control lever 30 which is pivoted at 31 to a fixed point. Movement of the link 29 towards the right or left will cause swinging or rocking movement of the lever 30. The link 29 is additionally connected to the position transducer 22 so that, upon deflection of the lever 30, the position transducer 22 will provide an output signal representative of this deflection.

The race 28 of the radial piston pump can be positioned by differential movement of the pistons 2', 3' similarly to the positioning of the mechanical element 1 of FIG. 1. The actual position of the race 28 is converted into an electrical signal by the position transducer 22. This actual position is compared in the electrical control unit 23 by the commanded position, as transduced by the position transducer 24. Error signals, if necessary, are then applied to the valves 5–8 to shift the slider of valve 4' laterally in either direction.

If the electrical control unit 23 should fail, then the position of the race 28 can be controlled manually by deflecting the lever 30, resulting in a hydro-mechanical servo control movement. The slider of the valve 4' is then deflected, and pressurized hydraulic fluid is directed to the pistons 2', 3', as explained in detail in connection with the pistons 2, 3 in FIG. 1. The operation is similar under the conditions of valves 5–8 being either open or closed if deenergized; if the system is so arranged that the valves open when deenergized, then hydraulic chokes 26, 27 should be used, as explained in connection with FIG. 1.

The system has been described in connection with rigidly mounted manual levers 18', 30. In normal operation, the manual levers 18', 30 will follow changes in position of the mechanical element 1, or 28, respectively, as the pistons 2, 3 or 2', 3' control deflection of the swash plate 1 or of the eccentric race 28. Movement of the levers 18', 30 thus is an indication of deflecting movement of the respective mechanical element. Under some conditions it is desired that the manual elements 18, 30 be fixed in space. The connection between the manual element and the lever 18, or 30, respectively, should then be effected by an overpressure spring 130. The spring path of deflection path of the overpressure spring then must be so selected that it covers the entire range of movement of the respective mechanical element 1, 28. The reset spring 405 must also be made sufficiently strong to hold the valve 4, 4' in position, absent movement of the manual portion of the lever 18, 30, respectively, that is, of the handle 18', 30'. Spring 130 is shown only in FIG. 2, for simplicity, as a balance spring acting on the mechanical portion 30' of the lever, for example above a linkage or pivot point which connects the manual portion 30' with the lever 30. Such manual override systems are well known and the showing, therefore, is only schematic.

The valves 5–8 are shown as separate valve units. These valves may, of course, be combined in a single housing or valve structure, for example as differential valves to, respectively, apply pressurized fluid to one of the pistons 2, 3 while permitting drainage of the other, and vice versa. All four valves could be combined into a single one, similar to the valves 4, 4', with an electrical control to move the valve spool relative to the valve housing.

Various changes and modifications may be made, and features described in connection with any one of the embodiments may be used with any of the others, within the scope of the inventive concept.

We claim:

1. Electro-mechanical control system for hydraulic displacement pumps, such as swash plate or eccentric pumps, having a movable, mechanical element (1, 28) controlling the pump displacement;

hydraulic piston means 2, 3; 2', 3') acting on the mechanical element and controlling the displacement of the pump as a function of its position;

a pressure fluid source (13) supplying hydraulic pressure fluid to operate said piston means;

an electrical control unit (23) and command means (24, 25) connected to said control unit (23) to enter commands to control said mechanical element (1, 28)

and comprising, in accordance with the invention, a group of selectively electrically energizable valve means (5, 6, 7, 8) electrically connected to and controlled by said control unit and hydraulically connecting said source (13) and said piston means (2, 3; 2', 3') to selectively apply pressurized hydraulic fluid to said piston means under command of said control unit (23);

a main control valve (4, 4') connected to said source and to said valve means (5, 6, 7, 8);

a manual control lever (18, 30) for said first control valve (4);

a position transducer (22) coupled to said manual control lever and electrically connected to said electrical control unit (23);

mechanical linkage means (15, 16, 17, 18, 19; 29) interconnecting said mechanical element 1,28), and said manual control lever (18, 30) to provide feedback signals from said mechanical element (1, 28) to said control unit and thereby provide a closed control loop for the control unit—valve means—mechanical element positioning system;

and means (405) normally maintaining said main control valve (4, 4') in position (401) in which fluid flow from the source (13) through the main control valve (4) is interrupted, while permitting movement of said manual control lever (18, 30) by said link means under automatic control and while further permitting manual override under conditions of failure in the electrical system connected to said electrical control unit and direct control of said main control valve (4, 4') and hence control of application of pressurized hydraulic fluid to said piston means (2, 3; 2', 3').

2. System according to claim 1, wherein (FIG. 1) the pump is a swash plate or wobble plate piston pump;

and the movable mechanical element (1) is the swash plate or wobble plate of said pump.

3. System according to claim 1, wherein (FIG. 2) said pump is a radial piston pump; and the movable mechanical element (28) is an eccentric race of said pump.

4. System according to claim 1, wherein said mechanical linkage means (15–19; 29) is connected to move said manual control lever in dependence on movement of said movable mechanical element (1, 28) so that said control lever will follow the movement of said mechanical element, said position transducer providing an output signal representative of movement of said manual control lever and hence of said mechanical element (1, 28) without, however, operating said main control valve;

and wherein said means maintaining said main control valve in said fluid-interrupting position (401) comprises a holding spring (405).

5. System according to claim 4, wherein (FIG. 1) said main control valve is a slider valve, and said linkage means (15–19) is connected to the slider of said valve.

6. System according to claim 4, wherein (FIG. 3) said valve is a slider valve and said linkage means is connected to the housing of said slider valve.

7. System according to claim 1, wherein said linkage means comprises a plurality of link elements;

and spring means (21) are provided located at the junction of link elements to compensate for play at joints forming said junctions.

8. System according to claim 1, wherein said valve means (5–8) are of the type that are open, when deenergized.

9. System according to claim 1, wherein said valve means are interconnected in the form of differential valves.

10. System according to claim 1, wherein said valve means operate, functionally, as slider valves.

11. System according to claim 1, wherein said manual control lever (18, 30) is an articulated lever;

and overpressure spring means (130) are provided to permit movement of a portion of the articulated lever as a consequence of movement of said mechanical linkage means while holding the other articulated portion essentially steady.

12. System according to claim 1, wherein said valve means (5–8) are of the type that is open when deenergized;

and wherein choke means (26, 27) are connected serially in the fluid paths of at least some of said valve means to prevent bypassing of fluid connections established by said main control valve (4, 4') upon movement thereof by said manual control lever (18, 30).

13. System according to claim 1, wherein said means (405) normally maintaining said main control valve (4,4') in position comprises a spring (405) of sufficient strength to override moving forces arising in said mechanical linkage means (15–19; 29) to enable said mechanical linkage means to form a portion of the closed control loop, said manual control lever (18, 30), upon manual operation and override of the force of said spring (405) thereby including operation of said main control valve (4, 4') in said control loop when the manual control lever (18) is operated.

* * * * *